US006615462B2

(12) United States Patent
Strudel

(10) Patent No.: US 6,615,462 B2
(45) Date of Patent: Sep. 9, 2003

(54) MAGNETICALLY SUPPORTED CIRCULAR SPREADER FOR TREATING TUBULAR TEXTILE GOODS

(75) Inventor: Werner Strudel, Friedrichshafen (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 0 days.

(21) Appl. No.: 10/283,917

(22) Filed: Oct. 29, 2002

(65) Prior Publication Data

US 2003/0079322 A1 May 1, 2003

(30) Foreign Application Priority Data

Oct. 31, 2001 (DE) ..... 101 53 691

(51) Int. Cl.[7] ..... D06C 5/00
(52) U.S. Cl. ..... 26/80
(58) Field of Search ..... 26/80, 81, 82, 26/83, 84, 85, 87, 88; 264/290.2

(56) References Cited

U.S. PATENT DOCUMENTS 2,507,599 A * 5/1950 Johnson ..... 26/84
2,517,067 A * 8/1950 Wedler ..... 26/80
2,623,263 A * 12/1952 Dungler ..... 26/84
3,955,251 A * 5/1976 Hogendyk ..... 26/80
4,306,340 A * 12/1981 Strudel et al. ..... 26/85
4,337,630 A 7/1982 Strahm
4,446,632 A * 5/1984 Dornier ..... 34/103
4,473,929 A * 10/1984 Green ..... 26/80
4,608,767 A * 9/1986 Dornier ..... 34/103
4,885,826 A 12/1989 Strudel
5,229,055 A * 7/1993 Wintermantel et al. ..... 26/85
5,884,376 A * 3/1999 Bertoldo ..... 26/80
5,884,377 A 3/1999 Rutz et al.
6,016,591 A 1/2000 Strudel et al.
6,389,663 B1 * 5/2002 Milanese et al. ..... 26/80
6,499,202 B1 * 12/2002 Milanese et al. ..... 26/80

FOREIGN PATENT DOCUMENTS

DE 2935374 1/1981

* cited by examiner

*Primary Examiner*—Amy B. Vanatta
(74) *Attorney, Agent, or Firm*—W. F. Fasse; W. G. Fasse

(57) ABSTRACT

A circular spreader for spreading tubular textile goods includes a spreader arrangement with an inlet mandrel and an outlet mandrel at opposite ends thereof inside the tubular goods, an inlet support structure arranged around the inlet mandrel outside of the tubular goods with an inlet guide gap therebetween, and an outlet support structure arranged around the outlet mandrel outside of the tubular goods with an outlet guide gap therebetween. The mandrels and the support structures are magnetic, to magnetically repel each other across the guide gaps. The components may be permanent magnets or electromagnets, or have separate discrete magnets provided thereon. The spreader arrangement is supported by magnetic levitation relative to the support structures, without direct contact therebetween. The tubular goods pass through the guide gaps with low friction, no pressing force exerted thereon, and no impairment of the structure or quality thereof.

20 Claims, 2 Drawing Sheets

MAGNETICALLY SUPPORTED CIRCULAR SPREADER FOR TREATING TUBULAR TEXTILE GOODS

PRIORITY CLAIM

This application is based on and claims the priority under 35 U.S.C. §119 of German Patent Application 101 53 691.7, filed on Oct. 31, 2001, the entire disclosure of which is incorporated herein by reference.

FIELD OF THE INVENTION

The invention relates to a circular spreader apparatus including a spreader arrangement that is supported inside of tubular textile goods, such as tubular knit goods, so as to spread out or expand the tubular goods during the treatment or processing thereof.

BACKGROUND INFORMATION

During various processing steps or treatments of tubular textile goods, such as tubular knit goods, it is advantageous to spread out or expand the tubular goods in a circular or tubular manner. For this reason, conventionally known apparatus for treating tubular goods typically include at least one tubular expander or circular spreader that is arranged inside the tubular goods, but must be supported in some manner from outside the tubular goods. The circular spreader, from inside the tubular goods, radially outwardly spreads or expands the goods in a triangular or multi-sided polygonal or nearly round cross-sectional shape. Thus the term "circular" spreader generally does not imply a true circular shape. The tubular goods are guided and supported over suitable guide elements, such as guide rollers of the internally arranged circular spreader.

As mentioned above, it is necessary to support the internally arranged circular spreader from outside of the tubular goods. This may be achieved, for example, simply by providing support roller arrangements outside of the tubular goods, so as to support the weight of and to properly position the circular spreader arranged inside the tubular goods. That of course means that the textile material of the tubular goods passes between the external support rollers and the internal circular spreader guide elements, whereby the supporting forces are transmitted through the textile fabric of the tubular goods. Disadvantageously, that can impair or deteriorate the quality of the goods, and in any event, applies additional loads to the textile fabric, which should preferably be avoided.

German Patent DE 29 35 374 and corresponding U.S. Pat. No. 4,337,630 (Strahm) disclose a known circular spreader that aims to avoid the direct mechanical support of the circular spreader by support rollers. Instead, these patents provide for the floating support of the circular spreader on a cushion of a pressurized fluid, such as a pressurized liquid or a pressurized gas, e.g. air. Particularly, the known circular spreader includes a conically tapering inlet guide part or mandrel and a conically tapering outlet guide part or mandrel at opposite ends of a central support. Furthermore, the conventional arrangement includes an inlet support structure that has a configuration matching the tapered shape of the inlet mandrel and that extends around the inlet mandrel with a guide gap therebetween, as well as an outlet support structure that has a configuration matching the tapered shape of the outlet mandrel and that extends around the outlet mandrel with a guide gap therebetween. The tubular goods are transported through the respective guide gaps between the support structures and the mandrels. The two support structures are each provided with suitable outlet openings on their respective inner circumferential surfaces facing the respective inlet and outlet mandrels, and a pressurized flow medium (a liquid or a gas) is ejected from the outlet openings toward the respective associated mandrel, so as to develop a pressurized cushion of fluid in each guide gap between each support structure and the associated mandrel. Thereby, the circular spreader is supported and held in position relative to the support structures in a contact-less manner by the pressurized fluid cushions.

Disadvantageously, the provision of a sufficient quantity of pressurized fluid at a sufficient pressure to maintain the floating support of the circular spreader, while forming and maintaining a sufficiently large tubular goods guide gap between the support structures and the mandrels, requires relatively complex, costly and problematic technical means, for example relatively powerful pressure-generating pumps or compressors, and painstaking arrangement and adjustment of the components, in order to prevent a binding surface pressure or contact between the cooperating support structures and mandrels of the circular spreader, so as to avoid damaging or deteriorating the quality of the tubular goods being processed. Furthermore, the flowing pressurized medium, e.g. a pressurized liquid or gas, ejected from the outlet openings of the support structures must penetrate directly through the textile material of the tubular goods in order to floatingly support the internally arranged mandrels of the circular spreader. This itself can disadvantageously influence the structure and the quality of the textile material of the tubular goods.

SUMMARY OF THE INVENTION

In view of the above, it is an object of the invention to further develop and improve a circular spreader of the generally known type, so as to effectively avoid a surfacial pressing or squeezing of the tubular goods in both the inlet area as well as the outlet area of the circular spreader, while supporting and positioning the circular spreader without requiring high ongoing operating costs or difficulties, and while avoiding any impairment or deterioration of the structure or quality of the textile fabric of the tubular goods. It is another object of the invention to achieve the easy adjustability of the size of the guide gaps for best accommodating different types of tubular goods. The invention further aims to avoid or overcome the disadvantages of the prior art, and to achieve additional advantages, as apparent from the present specification. The attainment of these objects is, however, not a required limitation of the claimed invention.

The above objects have been achieved according to the invention in a circular spreader for spreading tubular textile goods, comprising a central telescopable carrier or support post, a plurality of spreader arms that are radially extendable from the central carrier, struts that are carried by the spreader arms, guide elements such as guide rollers that are carried by the struts and that are adapted to guide and support the tubular goods, an inlet guide part or mandrel arranged at one end of the central carrier, an outlet guide part or mandrel arranged at the opposite end of the central carrier, an inlet support structure arranged substantially circumferentially around the inlet mandrel with an inlet guide gap therebetween, and an outlet support structure arranged substantially circumferentially around the outlet mandrel with an outlet guide gap therebetween. In this context, terms such as "substantially circumferentially around" do not require complete circumferential encircling, but rather require only that the external support structure extends around a sufficient portion of the total perimeter of the internally arranged mandrel so as to achieve the required support thereof. However, the support structure preferably extends around almost all of the perimeter of the mandrel, leaving only two gaps through which the tubular goods can pass while transitioning from a flat configuration to a circularly expanded configuration.

Particularly according to the invention, at least one of the inlet mandrel and the outlet mandrel is magnetic, e.g. comprises one or more magnets, and the respective associated inlet support structure or outlet support structure also is magnetic, e.g. comprises one or more magnets. Preferably, the mandrel and the associated support structure both at the inlet end as well as at the outlet end are magnetic in this manner. The magnets of the mandrel and of the associated support structure are respectively magnetically polarized so as to establish a magnetic repulsion between the respective mandrel and the associated support structure so as to maintain the guide gap therebetween due to the magnetic repulsion. In other words, the magnets of the respective mandrel and the associated support structure have the same magnetic polarity oriented with respect to each other so as to establish the magnetic repulsion.

Due to the fact that the corresponding magnetic poles repel each other, an air gap is formed between the magnetic inlet mandrel and the magnetic inlet support structure, and between the magnetic outlet mandrel and the magnetic outlet support structure, due to the respective magnetic repulsion therebetween. This air gap forms the respective tubular goods guide gap, through which the tubular goods can be easily transported without hindrance and without any mechanical pressing force being applied thereto. It is also not necessary for any sort of physical or mechanical supporting substance (e.g. like air jets or liquid jets) to pass physically through the tubular goods in order to floatingly support the internally arranged circular spreader. Instead, the magnetic forces of the like-poled mutually repulsive magnets of the internal mandrels and the external support structures achieve the floating support of the circular spreader inside the tubular goods. This does not cause any impairment, deterioration, or other influence on the structure or quality of the textile material of the tubular goods. It also ensures a very low friction on the tubular goods as the tubular goods pass through the respective guide gap.

According to particular detailed embodiments of the invention, the respective mandrel and/or the respective support structure itself may overall consist of magnetic material or magnetizable material, or may be embodied as an electromagnet. Alternatively, the respective mandrel and/or the respective support structure may comprise a non-magnetic body as well as separate magnets non-integrally mounted thereon or provided therein. In any event, any one of the magnets may be embodied as a permanent magnet or as an electromagnet. For example, a particular preferred embodiment involves the inlet and outlet mandrels comprising permanent magnets, while the inlet and outlet support structures comprise electromagnets.

Especially the electromagnets are adjustable, e.g. can be variably energized, so as to vary the magnetic field strength and thus the magnetic repulsive force generated thereby. This allows the gap size of the air gap, i.e. the goods guide gap, to be easily adjusted to adapt to different types or thicknesses of the goods being treated. The permanent magnets and the electromagnets must generate a sufficiently strong magnetic field to be able to establish the largest guide gap that may be required in the foreseeable operation of the apparatus. Furthermore, in connection with such an adjustment of the inlet and/or outlet guide gap in its width, to accommodate tubular goods of differing material thicknesses, it is preferable to construct the respective inlet support structure and/or the outlet support structure from at least two approximately circle segment-shaped parts of an annular ring, which are then each individually operatively connected to suitable actuating means for moving the ring parts and thereby mechanically adjusting the gap size.

The inventive arrangement achieves a contact-less magnetic levitation or floating support of the circular spreader inside the tubular goods. Thereby especially, the guide gaps between the mandrels and the associated support structures are established and maintained in a contact-less manner. The spread-out tubular goods, such as tubular knit goods, can be transported through any required treatment process, for example using gaseous or liquid treatment media, without causing any damage or impairment of the structure or quality of the tubular goods in the area of the inlet and the outlet of the circular spreader.

BRIEF DESCRIPTION OF THE DRAWINGS

In order that the invention may be clearly understood, it will now be described in connection with example embodiments thereof, with reference to the accompanying drawings, wherein.

DETAILED DESCRIPTION OF PREFERRED EXAMPLE EMBODIMENTS AND OF THE BEST MODE OF THE INVENTION

Figure 1:
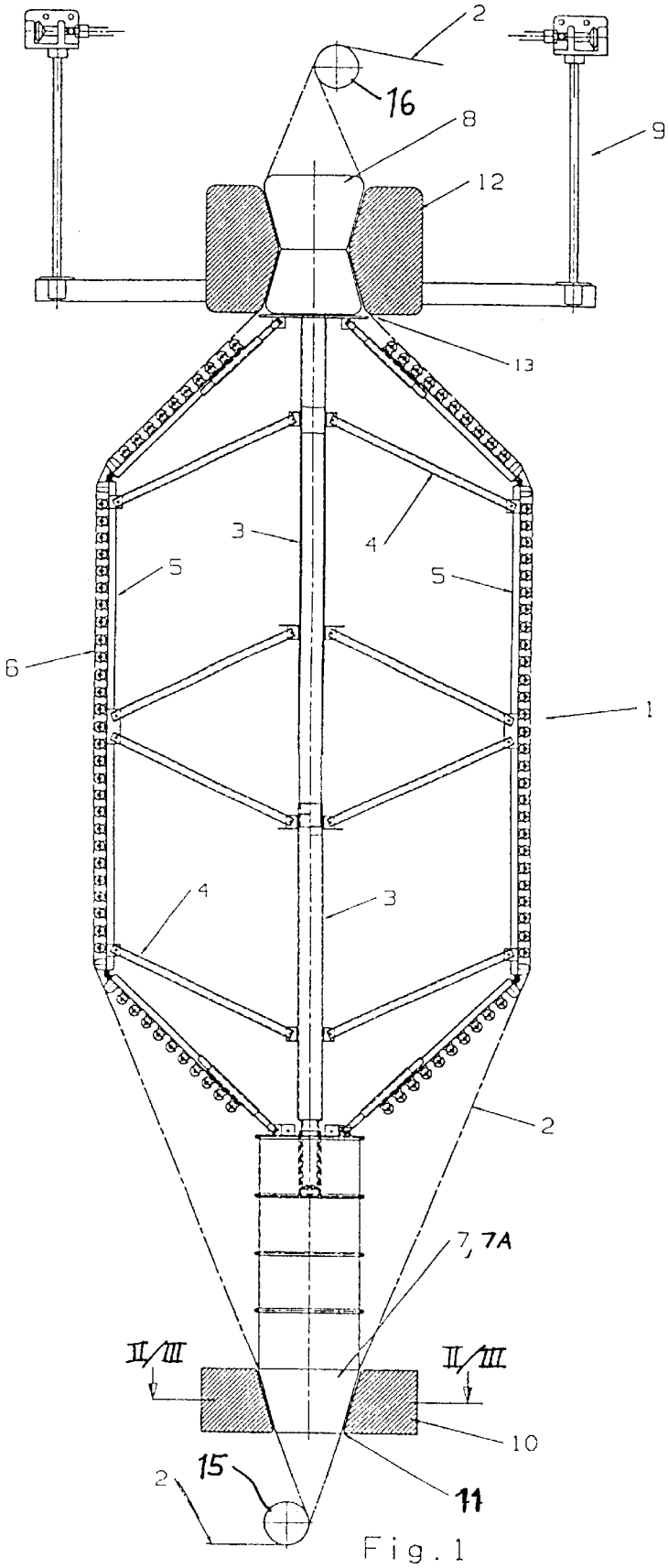
FIG. 1 is a schematic vertical sectional view of a circular spreader with magnetic inlet members and magnetic outlet members according to the invention.

As shown in FIG. 1, the inventive circular spreader 1 generally includes a central carrier 3, preferably embodied as a telescopable central post 3, plural radial spreader arms 4 that are pivotally carried by and can be selectively radially extended from the central carrier 3, several struts 5 carried by the radial spreader arms 4, and suitable guide elements 6 such as guide rollers 6 that are carried on the struts 5, and are adapted to glidingly support and guide the tubular goods 2, such as tubular knit goods 2, being transported thereover. Thereby, the tubular goods 2 are selectively variably spread or expanded in a substantially circular manner (e.g. a multi-sided polygonal manner).

Figure 2:
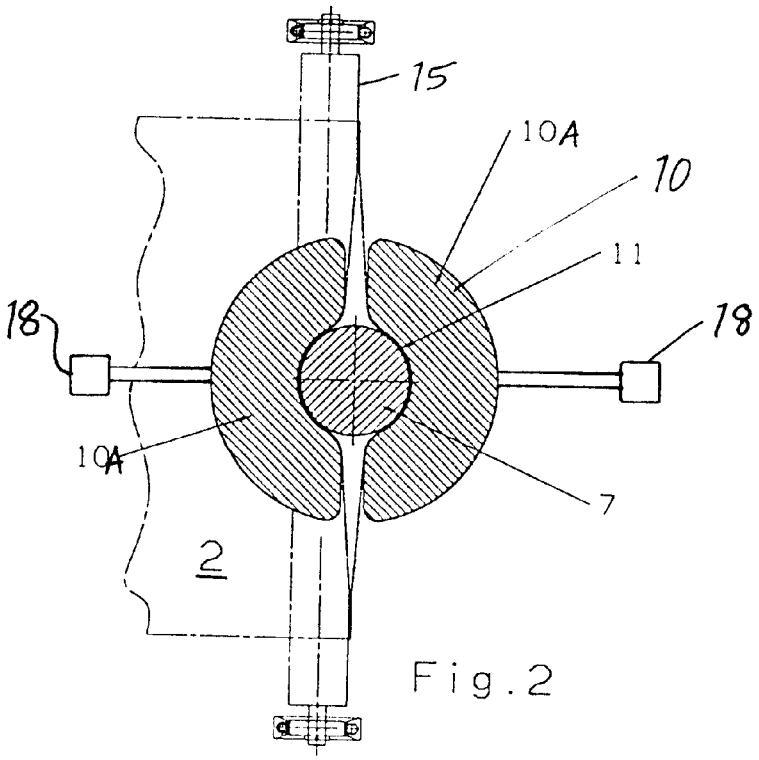
FIG. 2 is a sectional view of the magnetic inlet members of a rotationally symmetrical embodiment of the invention, along the section line II/III—II/III in FIG. 1.

The circular spreader 1 further includes an inlet guide part or inlet mandrel 7 arranged at one end of the central carrier 3, and an outlet guide part or outlet mandrel 8 arranged at the opposite end of the central carrier 3. The inlet mandrel 7 serves to guide and transition the tubular goods 2 from a flat condition as the goods 2 pass over an inlet roller 15, to the circular expanded condition as the goods 2 pass over the circular spreader 1 and particularly the guide elements 6 thereof. On the other hand, the outlet mandrel 8 serves to guide and transition the goods 2 from the circular expanded condition exiting the circular spreader 1, to a flat condition passing over an outlet roller 16. For this purpose, the inlet mandrel 7 has a truncated circular conical frustum configuration as seen in FIGS. 1 and 2, or a truncated tapering oval or elliptical configuration as shown by reference number 7A in FIGS. 1 and 3. Similarly, the outlet mandrel 8 may have a circular cross-section or an oval or elliptical cross-section, with a vertical section in the form of two opposed tapers or frustums tapering inwardly toward each other, i.e. toward a narrower tapered central waist, from respective larger upper and lower ends.

Figure 3:
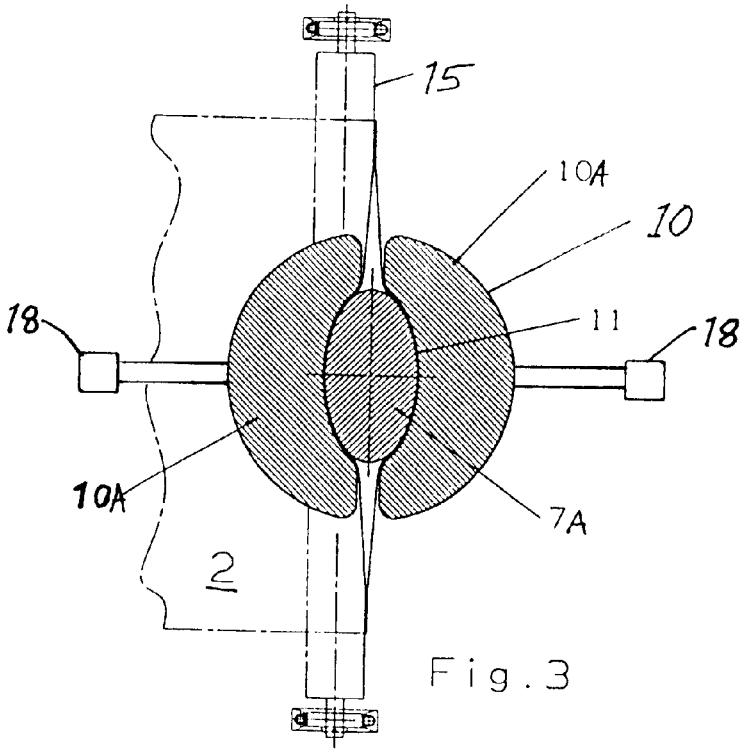
FIG. 3 is a sectional view similar to FIG. 2, taken along the section line II/III—II/III of FIG. 1, but showing an oval or elliptical embodiment of the magnetic inlet members.

The inventive apparatus further includes an inlet support structure 10 arranged outwardly around the inlet mandrel 7 with an inlet guide gap 11 therebetween, as well as an outlet support structure 12 arranged outwardly around the outlet mandrel 8 with an outlet guide gap 13 therebetween. Thus, the inlet support structure 10 has a vertical sectional shape substantially inversely matching (i.e. complementing or mating with) the tapered shape of the inlet mandrel 7 or 7A, while the outlet support structure 12 has a vertical sectional shape substantially inversely matching the tapered waist configuration of the outlet mandrel 8. Alternatively, the inlet components 7, 7A, 10 could respectively have the same configuration as the outlet components 8, 12, or vice versa. The cross-sectional shape of the respective support structure also generally corresponds to or mates with the circular or oval or elliptical cross-sectional shape of the respective mandrel, depending on the particular embodiment configuration of the mandrel, for example as shown in FIGS. 2 and 3.

More particularly, for example, the inlet support structure 10 may be made up of two annular segment shaped members 10A that together extend around substantially all (e.g. at least 90%) of the circumference of the inlet mandrel 7, 7A, while leaving the inlet guide gap 11 between the mandrel 7, 7A and the support structure 10, and while leaving two respective spaces between the two annular segment members 10A. As can be seen in FIGS. 2 and 3, the textile goods 2 transition through these spaces between the annular segment shaped members 10A, from a flat configuration leaving the inlet roller 15 to the circular expanded configuration on the circular expander 1. Similarly, the outlet support structure 12 preferably comprises two annular segment shaped members that substantially surround the outlet mandrel 8, in the same manner as the annular segment shaped members 10A substantially surround the inlet mandrel 7 or 7A.

Further especially according to the invention, the inlet components 7, 7A, 10, and/or the outlet components 8, 12 are respective magnetic components, i.e. respective magnets are provided on or integrated in the inlet mandrel 7 and the associated inlet support structure 10, as well as in or on the outlet mandrel 8 and the associated outlet support structure 12. These magnets may be provided at either the inlet end or the outlet end, but preferably at both the inlet end and the outlet end. In any event, the magnets of the respective mandrel 7, 8, and the magnets of the respective associated support structure 10, 12 are arranged or oriented with their magnetic poles, so as to achieve a magnetic repulsion across the respective guide gap 11, 13, between the respective support structure 10, 12, and the respective associated mandrel 7, 8. Particularly, the magnets are arranged so that the same magnetic poles of respective magnets are opposed to each other across the respective guide gap.

The magnets of the respective components 7, 8, 10, 12 may be separate discrete permanent magnets that are arranged on or in non-magnetic support bodies, or the respective component 7, 8, 10, 12 can be entirely embodied of a permanent magnetic material or a magnetizable material, or the respective component may be embodied as an electromagnet (with any conventionally known electromagnet structure). Preferably, the magnets of the mandrels 7 and 8 are permanent magnets, while the magnets of the external support structures 10 and 12 are electromagnets.

The energizing power of the electromagnets may be varied, so as to vary the magnetic field strength generated thereby, and correspondingly vary the magnetic repulsion relative to the associated mandrel 7, 8, so that the width of the respective guide gap 11, 13 can be correspondingly varied. Also, to vary the size of the respective guide gap 11, 13, the two annular segment members 10A of the inlet support structure 10, or similarly the two annular segment members of the outlet support structure 12, are preferably individually connected to and movably driven by suitable actuators 18, as schematically indicated in FIGS. 2 and 3 for the inlet support structure 10. Thus the guide gap is adjusted by correspondingly adjusting the physical position of the support structure members relative to the associated mandrel, while also correspondingly adjusting the magnetic repulsion force.

By adjusting the axial height of the outlet mandrel 8 supported by the outlet support structure 12, the telescoping axial length of the central carrier 3 of the circular spreader 1 is correspondingly adjusted, which in turn adjusts the radial spreading of the spreader arms 4. This is achieved in that the outlet support structure 12 is carried in a vertically adjustable manner by a lifter mechanism 9, which in general is conventionally known. The outlet support structure 12 thus forms the linkage between the circular spreader 1 and the lifter mechanism 9. The compound tapering shape of the outlet mandrel 8 is positively held and constrained, in both the radial and the axial directions, by the mating inverse internal shape of the outlet support structure 12. Thus, as the outlet support structure 12 is adjusted upwardly or downwardly, the outlet mandrel 8 necessarily moves correspondingly upwardly or downwardly.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A circular spreader apparatus for spreading textile tubular goods, comprising:

a spreader arrangement including radially outwardly directed spreading guide elements adapted to guide and support the tubular goods in a tubular expanded condition thereon;

a magnetic inlet mandrel connected to an inlet end of said spreader arrangement and adapted to have the tubular goods transported thereover;

a magnetic outlet mandrel connected to an outlet end of said spreader arrangement opposite said inlet end and adapted to have the tubular goods transported thereover;

a magnetic inlet support structure arranged radially outwardly around at least a portion of a perimeter of said inlet mandrel, forming an inlet guide gap adapted to have the tubular goods transported therethrough between said inlet mandrel and said inlet support structure; and a magnetic outlet support structure arranged radially outwardly around at least a portion of a perimeter of said outlet mandrel, forming an outlet guide gap adapted to have the tubular goods transported therethrough between said outlet mandrel and said outlet support structure;

wherein said magnetic inlet mandrel and said magnetic inlet support structure respectively have such a magnetic polarization so as to magnetically repel each other across said inlet guide gap; and wherein said magnetic outlet mandrel and said magnetic outlet support structure respectively have such a magnetic polarization so as to magnetically repel each other across said outlet guide gap.

2. The circular spreader apparatus according to claim 1, wherein said spreader arrangement comprises a central carrier, radial spreader arms extending adjustably radially outwardly from said central carrier, and axially oriented struts carried by said radial spreader arms, with said spreading guide elements carried on said struts.

3. The circular spreader apparatus according to claim 1, further comprising a lifter mechanism connected to and axially movably carrying said outlet support structure.

4. The circular spreader apparatus according to claim 1, wherein said magnetic inlet mandrel, said magnetic outlet mandrel, said magnetic inlet support structure, and said magnetic outlet support structure respectively comprise respective permanent magnets.

5. The circular spreader apparatus according to claim 1, wherein said magnetic inlet mandrel, said magnetic outlet mandrel, said magnetic inlet support structure, and said magnetic outlet support structure respectively comprise respective electromagnets.

6. The circular spreader apparatus according to claim 5, wherein said electromagnets are variable electromagnets of which an energizing power can be adjusted to adjust a magnetic force generated thereby.

7. The circular spreader apparatus according to claim 1, wherein said magnetic inlet mandrel and said magnetic outlet mandrel respectively comprise respective permanent magnets, and said magnetic inlet support structure and said magnetic outlet support structure respectively comprise respective electromagnets.

8. The circular spreader apparatus according to claim 7, wherein said electromagnets are variable electromagnets of which an energizing power can be adjusted to adjust a magnetic force generated thereby.

9. The circular spreader apparatus according to claim 1, wherein said respective support structures are respectively radially movably supported relative to said respective mandrels so that a gap size of said respective guide gaps is adjustable.

10. The circular spreader apparatus according to claim 9, wherein each one of said respective support structures comprises two members that are separately movable relative to each other, and that each have an annular segment cross-sectional shape extending at least partially around said respective mandrel.

11. The circular spreader apparatus according to claim 1, wherein said mandrels are each a respective rotationally symmetrical body having a circular cross-section.

12. The circular spreader apparatus according to claim 1, wherein said mandrels each respectively have an oval or elliptical cross-section.

13. The circular spreader apparatus according to claim 1, wherein said respective support structures have an inner contour radially inwardly facing a respective one of said mandrels, wherein said inner contour is an inverse complement of an outer contour of said respective one of said mandrels.

14. The circular spreader apparatus according to claim 1, wherein said inlet mandrel and said outlet mandrel both have the same configuration as each other, and said inlet support structure and said outlet support structure both have the same configuration as each other.

15. The circular spreader apparatus according to claim 1, wherein said outlet mandrel and said outlet support structure respectively have a different configuration than said inlet mandrel and said inlet support structure respectively.

16. The circular spreader apparatus according to claim 15, wherein said inlet mandrel has an axial sectional shape that tapers monotonously away from said spreader arrangement, and said outlet mandrel has an axial sectional shape that includes two opposed tapering portions that taper from respective wider ends inwardly to a narrower waist therebetween.

17. The circular spreader apparatus according to claim 1, wherein said outlet mandrel and said outlet support structure respectively have such mating axial sectional shapes, so that said outlet mandrel is held and constrained both axially and radially by said outlet support structure.

18. The circular spreader apparatus according to claim 1, wherein said mandrels each respectively comprise a non-magnetic body and discrete permanent magnets connected non-integrally to said non-magnetic body.

19. The circular spreader apparatus according to claim 1, wherein said mandrels each respectively consist of permanent magnetic material or magnetizable material.

20. A circular spreader apparatus for spreading textile tubular goods, comprising:

a spreader arrangement including radially outwardly directed spreading guide elements adapted to guide and support the tubular goods in a tubular expanded condition thereon;

a magnetic first mandrel connected to a first end of said spreader arrangement and adapted to have the tubular goods transported thereover;

a second mandrel connected to a second end of said spreader arrangement opposite said first end and adapted to have the tubular goods transported thereover;

a magnetic first support structure arranged radially outwardly around at least a portion of a perimeter of said first mandrel, forming a first guide gap adapted to have the tubular goods transported therethrough between said first mandrel and said first support structure; and a second support structure arranged radially outwardly around at least a portion of a perimeter of said second mandrel, forming a second guide gap adapted to have the tubular goods transported therethrough between said second mandrel and said second support structure;

wherein said magnetic first mandrel and said magnetic first support structure respectively have such a magnetic polarization so as to magnetically repel each other across said first guide gap.

* * * * *